US008283614B2

(12) United States Patent
Kladias et al.

(10) Patent No.: US 8,283,614 B2
(45) Date of Patent: Oct. 9, 2012

(54) APPARATUSES USEFUL IN PRINTING AND METHODS OF FIXING MARKING MATERIALS ONTO MEDIA

(75) Inventors: Nicholas P. Kladias, Fresh Meadows, NY (US); Gerald A. Domoto, Briarcliff Manor, NY (US); Donald M. Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 452 days.

(21) Appl. No.: 12/647,967

(22) Filed: Dec. 28, 2009

(65) Prior Publication Data

US 2011/0155721 A1 Jun. 30, 2011

(51) Int. Cl.
*H05B 6/10* (2006.01)

(52) U.S. Cl. ..... 219/634; 219/660; 219/672; 358/1.9; 358/3.23

(58) Field of Classification Search ..... 219/634, 219/660, 672; 358/1.9, 3.23
See application file for complete search history.

(56) References Cited

U.S. PATENT DOCUMENTS 7,633,647 B2 * 12/2009 Mestha et al. ..... 358/1.9
2005/0025538 A1 2/2005 Omata
2008/0037069 A1 2/2008 Mestha et al.

* cited by examiner

*Primary Examiner* — David Nhu
(74) *Attorney, Agent, or Firm* — Ronald E. Prass, Jr.; Prass LLP

(57) ABSTRACT

Apparatuses useful for printing and methods of fixing marking materials onto media are disclosed. An exemplary embodiment of the apparatuses useful in printing includes a first member including a first surface; a second member comprising at least one ferromagnetic material having a relative magnetic permeability greater than 1, a susceptor over the at least one ferromagnetic material, the susceptor comprising at least one electrically resistive metal, and a second surface over the at least one ferromagnetic material and the susceptor, the second surface forming a nip with the first surface at which media are received; and a magnetic field generator for generating a magnetic field to inductively heat the second member.

27 Claims, 12 Drawing Sheets

APPARATUSES USEFUL IN PRINTING AND METHODS OF FIXING MARKING MATERIALS ONTO MEDIA

BACKGROUND

Some printing apparatuses include opposed members that form a nip. In such apparatuses, media are fed to the nip and contacted by the members to fix marking material onto the media.

It would be desirable to provide apparatuses useful in printing and associated methods that utilize induction heating of fixing members.

SUMMARY

Apparatuses useful in printing and methods of fixing marking materials onto media are provided. An exemplary embodiment of the apparatuses comprises a first member comprising a first surface; a second member comprising at least one ferromagnetic material having a relative magnetic permeability greater than 1; a susceptor over the at least one ferromagnetic material, the susceptor comprising at least one electrically resistive metal; and a second surface over the at least one ferromagnetic material and the susceptor, the second surface forming a nip with the first surface at which media are received; and a magnetic field generator for generating a magnetic field to inductively heat the second member.

DRAWINGS

Figure 11:
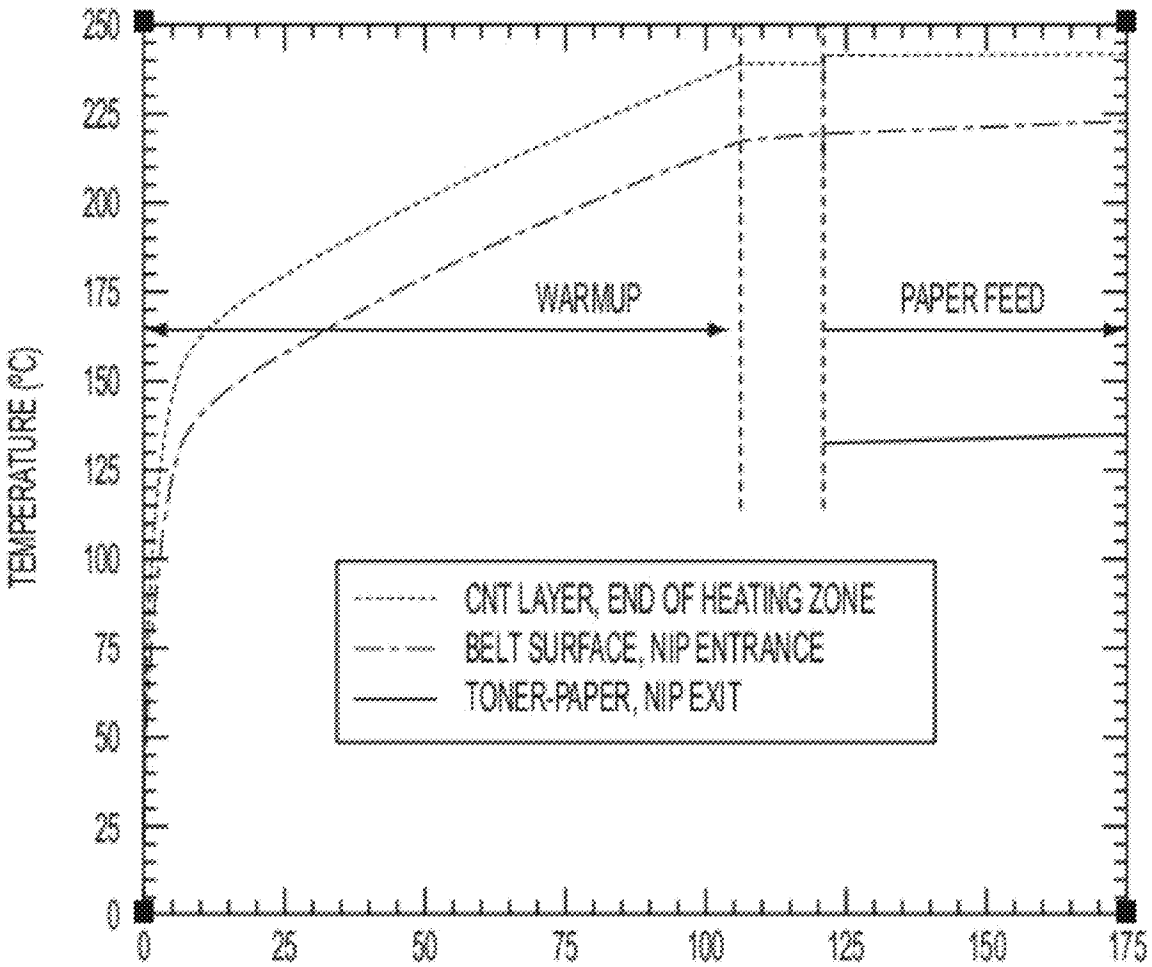

FIG. 11 shows plots of the temperature as a function of time in a fixing device including a backer roll with a ferrite layer, a fixing belt with a susceptor layer comprising carbon nanotubes and an induction coil having 300 Amp-turns for inductively heating the fixing belt, with the temperature taken at: (a) the susceptor layer at the end of a heating zone, (b) the outer surface of the fixing belt proximate to a nip entrance and (c) a marking material/medium interface, at a process speed of 350 ppm.

Figure 12:
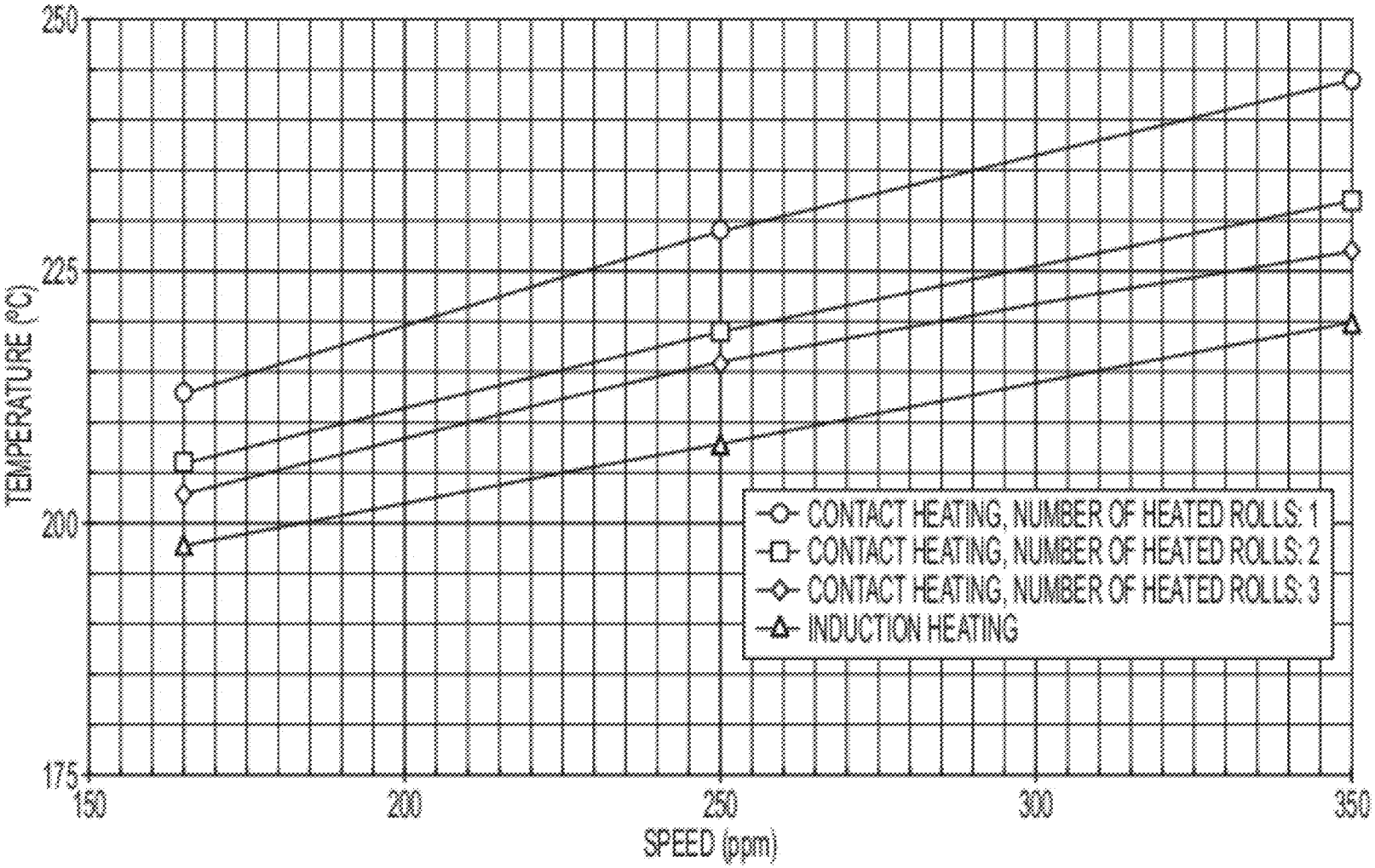

FIG. 12 shows plots of the maximum temperature of a fixing belt as a function of process speed for three different fixing devices including a fixing belt heated by contact heating via one heated roll, two heated rolls and three heated rolls, and for a fixing device including a fixing belt heated by induction heating.

Figure 13:
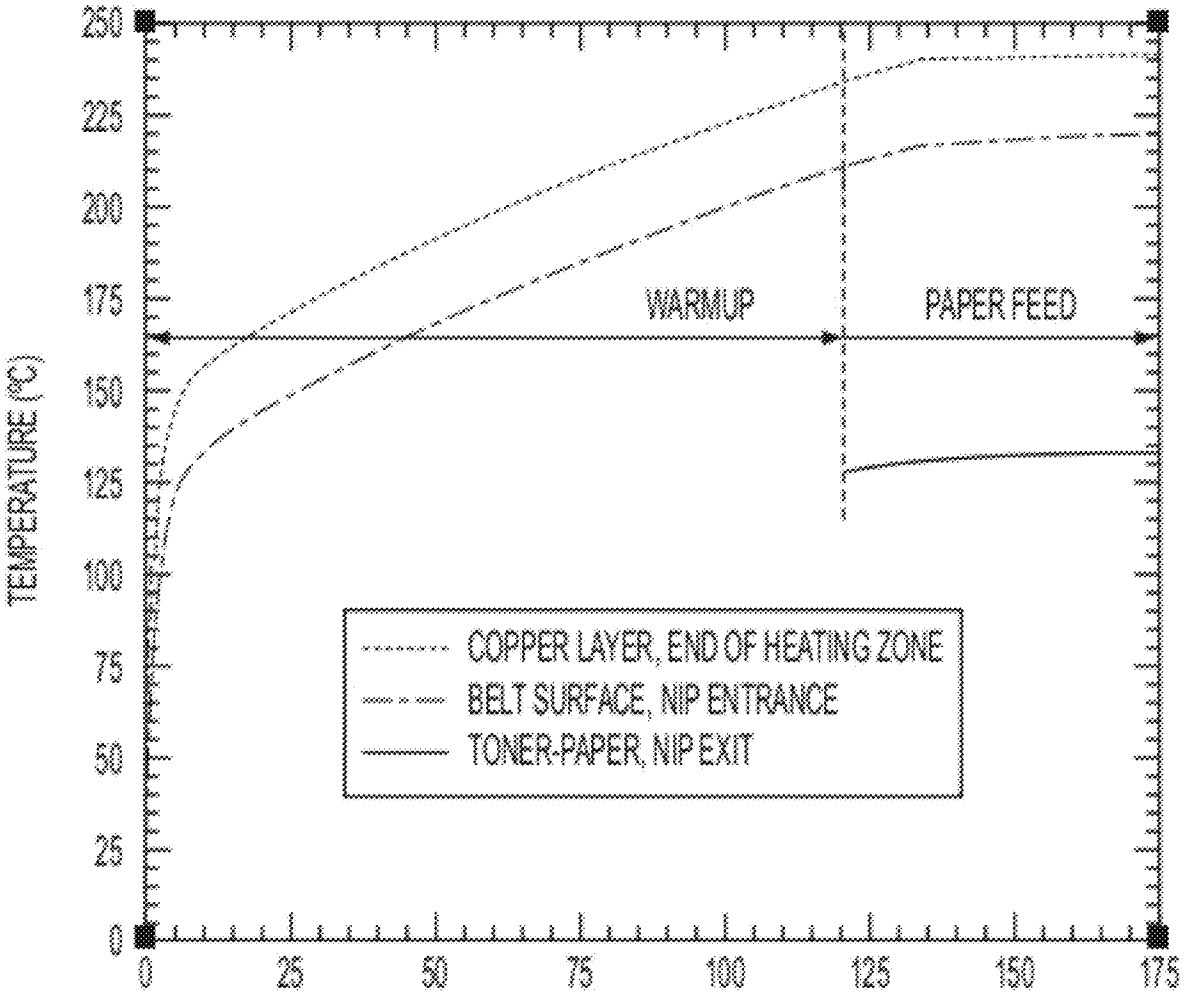

FIG. 13 shows the temperature as a function of time in a fixing device including a backer roll having a ferrite layer, a fixing belt including a susceptor layer comprising copper and an induction coil having 1000 Amp-turns for inductively heating the fixing belt, with the temperature taken at: (a) the susceptor layer at the end of a heating zone, (b) the outer surface of the fixing belt proximate to a nip entrance and (c) a marking material/medium interface, at a process speed of 350 ppm.

DETAILED DESCRIPTION

The disclosed embodiments include apparatuses useful in printing. An exemplary embodiment of the apparatuses comprises a first member comprising a first surface; a second member comprising at least one ferromagnetic material having a relative magnetic permeability greater than 1, a susceptor over the at least one ferromagnetic material, the susceptor comprising at least one electrically resistive metal, and a second surface over the at least one ferromagnetic material and the susceptor, the second surface forming a nip with the first surface at which media are received; and a magnetic field generator for generating a magnetic field to inductively heat the second member.

The disclosed embodiments further include an apparatus useful in printing comprising a first roll comprising a first surface; a second roll comprising a ferromagnetic layer comprising at least one ferromagnetic material having a relative magnetic permeability greater than 1, a susceptor layer over the ferromagnetic layer, the susceptor layer comprising at least one electrically resistive metal, and a second surface over the ferromagnetic layer and the susceptor layer, the second surface forming a nip with the first surface at which media are received; and a magnetic field generator for generating a magnetic field to inductively heat the second roll.

The disclosed embodiments further include an apparatus useful in printing comprising a first roll comprising a first surface; a second roll comprising a ferromagnetic layer comprising at least one ferromagnetic material having a relative magnetic permeability greater than 1; a fixing belt provided on the second roll, the fixing belt comprising a susceptor layer comprising at least one electrically resistive metal, and a second surface forming a nip with the first surface at which media are received; and a magnetic field generator for generating a magnetic field to inductively heat the fixing belt.

The disclosed embodiments further include methods of fixing marking materials onto media in apparatuses useful in printing. An exemplary embodiment of the methods is provided in which the apparatus comprises a first member including a first surface; a second member comprising at least one ferromagnetic material having a relative magnetic permeability greater than 1, a susceptor over the at least one ferromagnetic material, the susceptor comprising at least one electrically resistive metal, and a second surface over the at least one ferromagnetic material and the susceptor, the second surface forming a nip with the first surface; and a magnetic field generator. The method comprises generating a magnetic field with the magnetic field generator to inductively heat the second member including heating the second surface; and feeding a medium with a marking material thereon to the nip and contacting the medium with the first surface and the heated second surface to fix the marking material onto the medium.

As used herein, the term "printing apparatus" encompasses any apparatus that performs a print outputting function for any purpose. Such apparatuses can include, e.g., printers, copiers, facsimile machines, multifunction machines, bookmaking machines, and the like.

Figure 1:
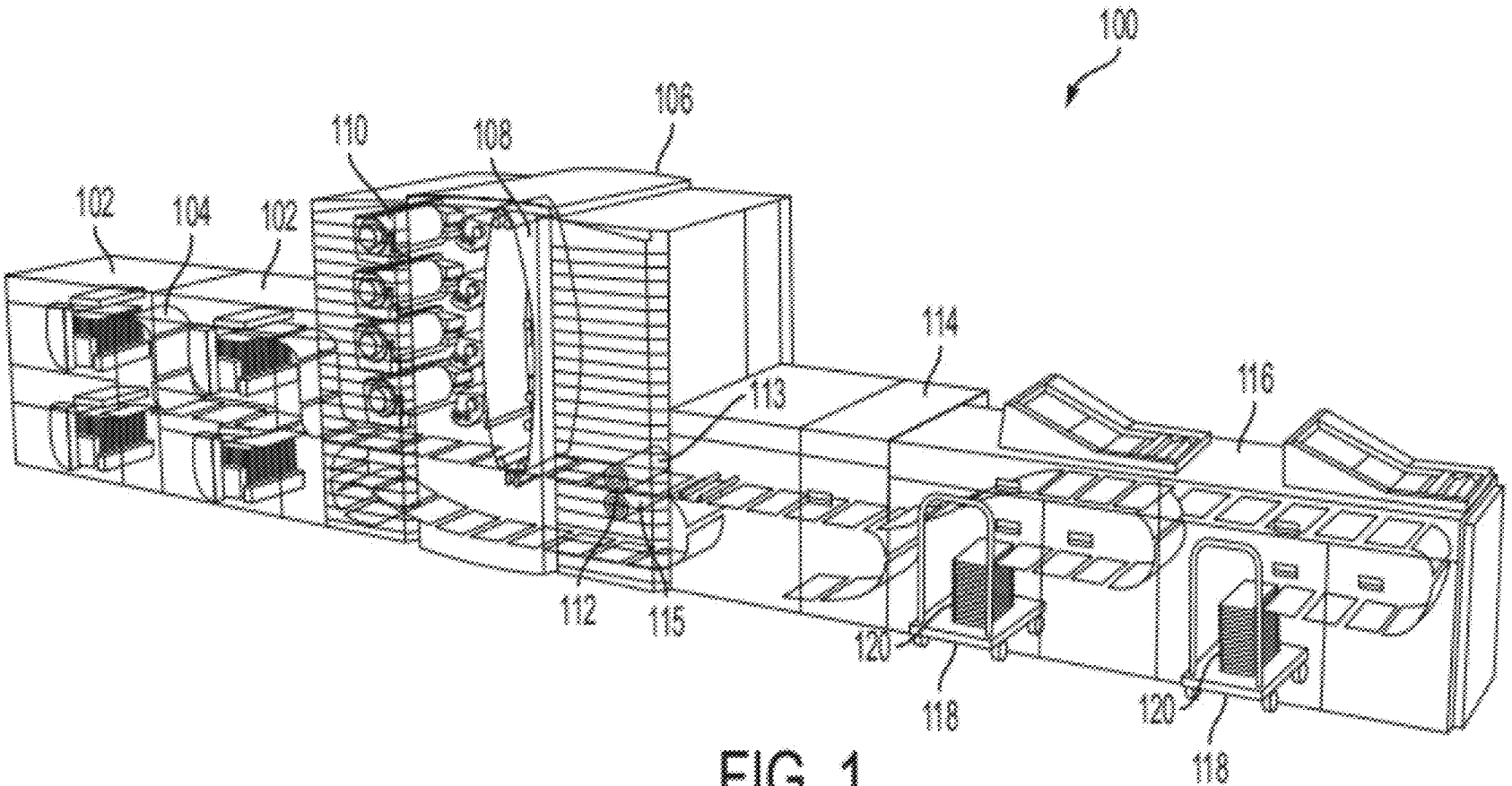
FIG. 1 depicts an exemplary embodiment of a printing apparatus.

FIG. 1 illustrates an exemplary printing apparatus 100, as disclosed in U.S. Patent Application Publication No. 20080037069, which is incorporated herein by reference in its entirety. The printing apparatus 100 can be used to produce prints from various types of media having different sizes and weights. The printing apparatus 100 includes two media feeder modules 102 arranged in series, a printer module 106 adjacent the media feeder modules 102, an inverter module 114 adjacent the printer module 106, and stacker modules 116 arranged in series adjacent the inverter module 114.

In the printing apparatus 100, the media feeder modules 102 feed media to the printer module 106. In the printer module 106, marking material (toner) is transferred from a series of developer stations 110 to a charged photoreceptor belt 108 to form toner images on the photoreceptor belt 108 and produce color prints. The toner images are transferred to one side of media 104 fed through the paper path. The media are advanced through a fixing device 112 including a fixing roll 113 and pressure roll 115. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

The fixing roll 113 and the pressure roll 115 together form a nip at which heat and pressure are applied to marking materials onto media, such as paper sheets.

It has been noted that high-speed fixing of marking materials onto media using fixing rolls/fixing belts heated with lamps, such as halogen lamps, is limited by the maximum allowable fixing roll/fixing belt temperature, as well as by the wattage density limit of the lamp filaments. In roll-type fixing devices, additional heating of the fixing roll may be provided by external heater rolls. Additional heated rolls are also used in belt-type fixing apparatuses to distribute thermal energy and avoid excessive roll temperatures. However, the additional heated rolls increase the size and complexity of the fixing devices.

It has been determined that induction heating could bring a substantial advantage in fixing device "packaging," and could result in simplified fixing device configurations by reducing the number of rolls that are involved for heating, especially for belt-type fixing devices. It would be desirable, however, to provide induction heated fixing devices that do not require the supply of high current and high frequency to heat the fixing rolls/fixing belts to temperatures sufficiently high for fixing marking materials at high productivity speeds.

In light of these and other considerations, apparatuses useful in printing and methods of fixing marking materials onto media are provided. Embodiments of the apparatuses can include roll-type fixing devices and belt-type fixing devices including an induction heating system. The fixing devices include at least one ferromagnetic material and a susceptor. The roll-type and belt-type fixing devices can provide high fixing speeds using a reduced amplitude/frequency of the applied current to produce inductive heating of the rolls and belts. The devices can also provide simplified architectures.

Embodiments of the apparatuses useful in printing can use various types of solid and liquid marking materials, including toners and inks (e.g., liquid inks, gel inks, heat-curable inks and radiation-curable inks), and the like. The apparatuses can use various thermal, pressure and other conditions to treat the marking materials and form images on media.

Figure 2:
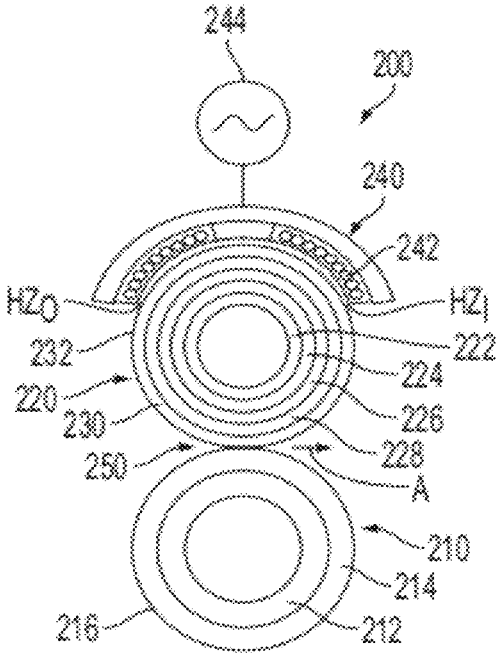
FIG. 2 depicts an exemplary embodiment of a fixing device including an induction heated fixing roll.

FIG. 2 illustrates an exemplary embodiment of a fixing device 200 useful in printing. Embodiments of the fixing device 200 can be used in different types of printing apparatuses. For example, the fixing device 200 can be used in the printing apparatus 100 shown in FIG. 1, in place of the fixing device 112.

As shown in FIG. 2, the fixing device 200 includes a pressure roll 210; a fixing roll 220 and a magnetic field generator 240 adjacent to the fixing roll 220. In other embodiments of the fixing devices, a belt (not shown) can alternatively be used as a fixing member instead of the pressure roll 210. The magnetic field generator 240 produces a magnetic field that is effective to inductively heat the fixing roll 220 to a desired temperature, e.g., a temperature sufficient for fixing marking materials onto media.

The magnetic field generator 240 includes at least one induction coil 242 and an RF power supply 244 connected to the induction coil 242. A controller (not shown) can be connected to the RF power supply 244. The illustrated induction coil 242 is positioned proximate to the outer surface 232 of the fixing roll 220. The induction coil 242 is configured to extend circumferentially about the outer surface 232 between a heating zone inlet, $HZ_I$, and a heating zone outlet, $HZ_O$. For example, the induction coil 242 can extend circumferentially over an angle of about 60° to about 180°. The induction coil 242 also extends along the axial direction of the fixing roll 220. The induction coil 242 is configured to heat at least a portion of the outer surface 232 of the fixing roll 220 that contacts media.

The RF power supply 244 produces an AC current. The AC current can typically have a frequency, f, of about 10 kHz to about 400 kHz. When AC current is flowed through the induction coil 242, the induction coil 242 generates a magnetic field. The magnetic field induces eddy currents in the fixing roll 220, resulting in inductive heating of the fixing roll 220.

The illustrated pressure roll 210 includes a core 212 and an outer layer 214 overlying the core 212. The outer layer 214 includes an outer surface 216. The outer layer 214 can comprise an elastically deformable material, such as silicone rubber, perfluoroalkoxy (PFA) copolymer resin, or the like. In embodiments, the pressure roll 210 can optionally be internally or externally heated by a thermal energy source.

The illustrated embodiment of the fixing roll 220 includes a core 222, a ferromagnetic layer 224 on the core 222, an elastomer layer 226 on the ferromagnetic layer 224, a susceptor layer 228 on the elastomer layer 226, and an outer layer 230 on the susceptor layer 228. The outer surface 232 of the outer layer 230 forms a nip 250 with the outer surface 216 of the pressure roll 210. Media are fed to the nip 250 to fix marking materials onto the media by the application of heat and pressure. The pressure roll 210 and fixing roll 220 are rotated in opposite directions to convey media through the nip 250 in the process direction A.

The fixing roll 220 is constructed from materials to reduce the amplitude/frequency of the AC current that is needed in the induction coil 242 to produce a given amount of inductive heating of the fixing roll 220. In the fixing roll 220, the core 222 can comprise any suitable metal, such as aluminum, steel or the like.

The ferromagnetic layer 224 comprises at least one ferromagnetic material having a sufficiently-high relative magnetic permeability to enhance the magnetic field produced by the magnetic field generator 240. The magnetic permeability, $\mu$, of a ferromagnetic material is defined as the ratio of flux density, B, to magnetic field strength, H: $\mu=B/H$. The relative magnetic permeability, $\mu_R$, of a material is defined as the ratio of the magnetic permeability $\mu$ to the permeability of a vacuum, $\mu_0$: $\mu_R=\mu/\mu_0$, where $\mu_0=4\pi\times10^{-7}$ H/m. Vacuum has a relative magnetic permeability $\mu_R$ of 1. Platinum and aluminum, for example, each also have a relative magnetic permeability $\mu_R$ of about 1.

Increasing the relative magnetic permeability $\mu_R$ increases the flux density for a given applied magnetic field strength H. In embodiments, the ferromagnetic layer 224 comprises at least one material having a relative magnetic permeability $\mu_R$ greater than 1, such as at least about 1.25, at least about 1.5, at least about 2, at least about 5, at least about 10, at least about 50, at least about 100, at least about 500, at least about 1,000, at least about 10,000, or higher.

The ferromagnetic materials used to form the ferromagnetic layer 224 can be magnetic ceramics and metals. TABLE 1 shows exemplary ferromagnetic materials that have a relative magnetic permeability $\mu_R$ of more than 1 and can be used in the ferromagnetic layer 224. As shown, the relative magnetic permeability values of the exemplary materials range from 8 up to 20,000.

TABLE 1

| Ferromagnetic Material | Relative Magnetic Permeability |
|---|---|
| Ferrite U60 | 8 |
| Nickel[1] | 100-600 |
| Magnetic Iron | 200 |
| Steel | 700 |
| Ferrite M33 | 750 |
| Ferrite N41 | 3,000 |
| Electrical Steel | 4,000 |
| Iron (99.8% pure) | 5,000 |
| Permalloy[2] | 8,000 |
| Ferrite T38 | 10,000 |
| Mumetal[3] | 20,000 |

[1]99% pure nickel has a relative magnetic permeability of 600.
[2]Permalloy contains 78.5% nickel and 21.5% iron.
[3]Mumetal contains 75% nickel, 2% chromium, 5% copper and 18% iron.

In embodiments, the ferromagnetic layer 224 can be made entirely of a single ferromagnetic material having a relative magnetic permeability $\mu_R$ of more than 1. In other embodiments, the ferromagnetic layer 224 can be made entirely of more than one ferromagnetic material having a relative magnetic permeability $\mu_R$ of more than 1, such as a mixture of two or more different ferrite materials. In other embodiments, the ferromagnetic layer 224 can comprise at least one ferromagnetic material having a relative magnetic permeability $\mu_R$ of more than 1 and at least one other non-ferromagnetic material. For example, the non-ferromagnetic material can form a matrix containing the at least one ferromagnetic material. Other embodiments of the ferromagnetic layer 224 can also be provided. In the embodiments, the ferromagnetic layers 224 have a composition and configuration that provides the desired properties in the fixing roll 220.

The ferromagnetic layer 224 can typically have a thickness of about 0.1 mm to about 5 mm. The ferromagnetic layer 224 can be in the form of a sleeve applied onto the core 222. In other embodiments, the ferromagnetic layer 224 can be a coating, including one or more layers, applied over the outer surface of the core 222 by any suitable coating technique.

In the fixing roll 220, the ferromagnetic layer 224 is effective to channel and confine the magnetic flux generated by the magnetic field generator 240 into the desired region of the fixing roll 220. As a result of this magnetic flux confinement, a substantial portion of the induced heating is confined to the desired region of the fixing roll 220.

The elastomer layer 226 of the fixing roll 220 can comprise any suitable elastomeric material, such as silicone rubber, and the like. The elastomer layer 226 can typically have a thickness of about 0.1 mm to about 0.3 mm. The elastomer layer 226 is elastically deformed when the fixing roll 220 is positioned in contact with the pressure roll 210 to form the nip 250.

The susceptor layer 228 is provided in the fixing roll 220 to absorb electromagnetic energy and convert this absorbed energy to thermal energy. The thermal energy is conducted outward from the susceptor layer 228 to heat the outer surface 232. The susceptor layer 228 comprises at least one electrically resistive metallic material. Eddy currents are generated in the susceptor layer 228 when the magnetic field generator 240 produces a magnetic field. The electrical resistance of the susceptor layer 228 in response to the eddy currents produces heating of the susceptor layer 228. The ferromagnetic layer 224 increases the induced eddy current in the susceptor layer 228.

The susceptor layer 228 has a resistivity, $\rho$, and a thickness, t. The ratio of $\rho/t$ of the susceptor layer 228 can be optimized to maximize eddy current heating of the susceptor layer 228 and, consequently, maximize heating of the fixing roll 228. The optimum range of the ratio of $\rho/t$ of the susceptor layer 228 is dependent on the frequency of the RF power supply 244, with this ratio typically shifting to higher values at higher frequencies.

The susceptor layer 228 can be made from any material(s) that provide(s) the desired heating effects in the fixing roll 220. The susceptor layer 228 can include one or more layers of the material(s). TABLE 2 shows exemplary materials that can be used in the susceptor layer 228. As shown, the resistivity values of the susceptor materials range from $1.59\times10^{-6}$ to $1.1\times10^{-4}$ $\Omega\cdot$cm. Carbon materials, e.g., particles, other than carbon nanotubes (e.g., carbon nanotube textile material) having a suitable resistivity can also be used in the susceptor layer 228. The carbon particles can be nano-sized or larger.

TABLE 2

| Material | Resistivity [$\Omega\cdot$cm] at 20° C. |
|---|---|
| Silver | $1.59\times10^{-6}$ |
| Copper | $1.72\times10^{-6}$ |
| Aluminum | $2.82\times10^{-6}$ |
| Tungsten | $5.6\times10^{-6}$ |
| Zinc | $5.9\times10^{-6}$ |
| Nickel | $6.99\times10^{-6}$ |
| Iron | $1.0\times10^{-5}$ |
| Platinum | $1.06\times10^{-5}$ |
| Tin | $1.09\times10^{-5}$ |
| Carbon Nanotubes | $1.0\times10^{-4}$ |
| Nichrome[1] | $1.1\times10^{-4}$ |

[1]Nichrome contains 80% nickel and 20% chromium by weight.

In embodiments, the susceptor layer 228 can be made entirely of a single susceptor material. In other embodiments, the susceptor layer 228 can be made entirely of more than one susceptor material (e.g., a mixture of two or more carbon materials, such as nano-sized carbon particles). In other embodiments, the susceptor layer 228 can comprise at least one susceptor material and at least one other material that is not an electrically resistive metal. For example, the other material can form a matrix containing the at least one susceptor material. In the embodiments, the susceptor layers 228 have a composition that provides the desired properties in the fixing roll 220.

For a given susceptor material, depending on the frequency of the RF power supply 244, the thickness of the susceptor layer 228 that provides an optimal value of the ratio of ρ/t to achieve maximum heating of the fixing roll 220 can be determined to reduce power costs. As the frequency of the RF power supply 244 is increased, the thickness of the susceptor layer 228 can be decreased to provide the optimum ratio of ρ/t that provides maximum heating.

For two different susceptor materials having different resistivity values, at the frequency of the power source, the same optimum value of the ratio of p/t can be achieved in the two materials by controlling their respective thicknesses.

In embodiments, it may be desirable to make the susceptor layer 228 from at least one material having a higher resistivity, e.g., at least about $1\times10^{-5}$ Ω·cm (e.g., iron), or at least about $1\times10^{-4}$ Ω·cm (e.g., carbon nanotubes), which allows the susceptor layer 228 to have a greater thickness than a material with a lower resistivity would need to have, in order to provide the same value of the ratio of ρ/t for the susceptor layer 228.

Using at least one material in the susceptor layer 228 that has a high resistivity, such as carbon nanotubes, can provide processing advantages. For example, the susceptor layer 228 can be made from carbon nanotubes with a thickness of about 80 μm. In contrast, a susceptor layer 228 made from copper and having the same value of the ratio of ρ/t as the susceptor layer 228 made from carbon nanotubes would have a thickness of only less than 2 μm. It would be more difficult to form a copper layer of only this thickness than the thicker layer of higher resistivity material, and it also would be difficult to meet the desired tolerances on the thickness of the copper layer. It is desirable to have close tolerances on the thickness of the susceptor layer 228 because large variations in the thickness would result in large variations in the induced eddy current heating, which could result in hot/cold spots in the susceptor layer 228 and non-uniform heating of the fixing roll 220.

Increasing the thickness of the susceptor layer 228 can (in order to provide the desired ratio of ρ/t) simplify processing by allowing the susceptor layer 228 to be formed using conventional deposition techniques, such as electrical plating, or the like, that can provide the desired tolerances.

In embodiments, the thickness of the susceptor layer 228 can typically range from about 10 μm to about 200 μm for different materials. For example, the susceptor layer 228 comprising carbon nanotubes, or other nano-sized carbon particles with a similar resistivity, can have a thickness of about 50 μm to about 200 μm. The value of the ratio of ρ/t of the susceptor layer 228 can typically range from about 0.005 Ω·cm/cm to about 0.1 Ω·cm/cm to provide desirable heating effects for current frequencies ranging from about 10 kHz to about 400 kHz.

In the fixing roll 220, the outer layer 230 can comprise any suitable polymeric material having sufficient release properties to reduce adherence of media and marking materials to the outer surface 232. For example, the outer layer 230 can comprise a fluoroelastomer sold under the trademark Viton® by DuPont Performance Elastomers, L.L.C., polytetrafluoroethylene (Teflon®), Teflon® PFA, a perfluoroalkoxy copolymer, and the like. The outer layer 230 can typically have a thickness of about 10 μm to about 30 μm.

Figure 3:
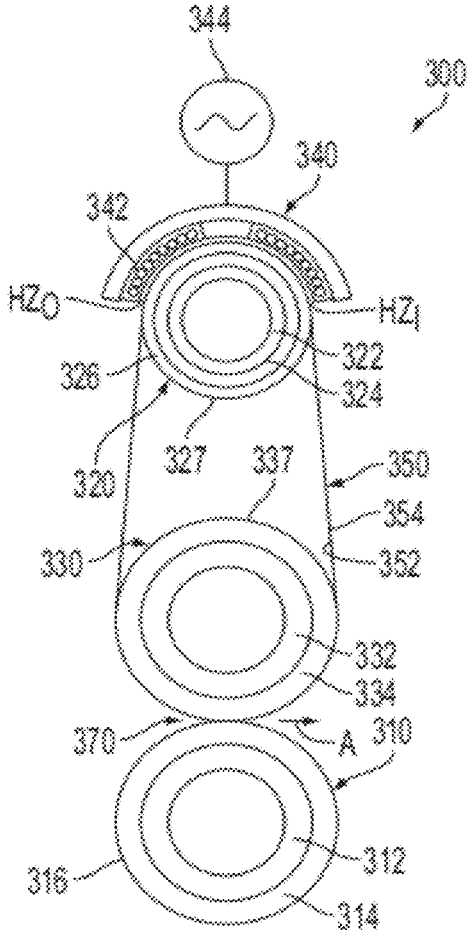
FIG. 3 depicts an exemplary embodiment of a fixing device including an induction heated fixing belt.

FIG. 3 depicts another exemplary embodiment of a fixing device 300 useful in printing. The fixing device 300 includes a pressure roll 310, a backer roll 320, a fixing roll 330, a magnetic field generator 340 and a fixing belt 350 mounted to the backer roll 320 and fixing roll 330. In other embodiments of the fixing devices, a belt (not shown) can alternatively be used as a fixing member instead of the pressure roll 310. In the fixing device 300, the pressure roll 310 and fixing belt 350 form a nip 370 to which media are fed to fix marking materials to the media. In the illustrated embodiment, the pressure roll 310 and fixing roll 330 are rotated in opposite directions to convey media through the nip 370 in the process direction A. The magnetic field generator 340 produces a magnetic field effective to inductively heat the rotating fixing belt 350 to the desired temperature. The heated fixing belt 350 is rotated to contact media at the nip 370.

The magnetic field generator 340 includes at least one induction coil 342 connected to an RF power supply 344. A controller (not shown) can be connected to the RF power supply 344. The illustrated induction coil 342 is positioned proximate to an outer surface 354 of the fixing belt 350. The induction coil 342 extends circumferentially about a portion of the fixing belt 350 contacting an outer surface 327 of the backer roll 320 between a heating zone inlet, $HZ_I$, and a heating zone outlet, $HZ_O$. The induction coil 342 can extend circumferentially over an angle of about 60° to about 180°, for example. The induction coil 342 extends in the axial direction of the backer roll 320 and fixing belt 350. The induction coil 342 is configured to heat at least a portion of the outer surface 354 of the fixing belt 350 that contacts media at nip 370.

The pressure roll 310 includes a core 312 and outer layer 314 overlying the core 312. The outer layer 314 includes an outer surface 316. The pressure roll 310 can have the same construction as the pressure roll 210 of the fixing device 200, for example. In embodiments, the pressure roll 310 can optionally be internally or externally heated with a thermal energy source.

The illustrated embodiment of the backer roll 320 includes a core 322, a ferromagnetic layer 324 on the core 322, and an elastomer layer 326 on the ferromagnetic layer 324. The elastomer layer 326 includes the outer surface 327 contacting the fixing belt 350.

The backer roll 320 is constructed to reduce the amplitude/frequency of the AC current that is needed in the induction coil 342 to produce a given amount of heating of the fixing belt 350. In the backer roll 320, the core 322 can comprise any suitable metal, such as aluminum, steel or the like.

The ferromagnetic layer 324 comprises at least one material having a sufficiently-high relative magnetic permeability to enhance the magnetic field produced by the magnetic field generator 340. In embodiments, the ferromagnetic layer 324 comprises at least one material having a relative magnetic permeability $\mu_R$ of more than 1, such as at least about 1.25, at least about 1.5, at least about 2, at least about 5, at least about 10, at least about 50, at least about 100, at least about 500, at least about 1,000, at least about 10,000, or higher. The ferromagnetic layer 324 can have the same composition and dimensions as embodiments of the ferromagnetic layer 224 of the fixing roll 220 of the fixing device 200, for example.

In the backer roll 320, the ferromagnetic layer 324 is effective to channel and confine the magnetic flux generated by the magnetic field generator 340 into the desired region of the fixing belt 350, resulting in a substantial portion of the induced heating being confined in the desired region of the fixing belt 350.

The elastomer layer 326 can have the same composition and dimensions as those of the elastomer layer 226 of the fixing roll 220 of the fixing device 200, for example.

Figure 4:
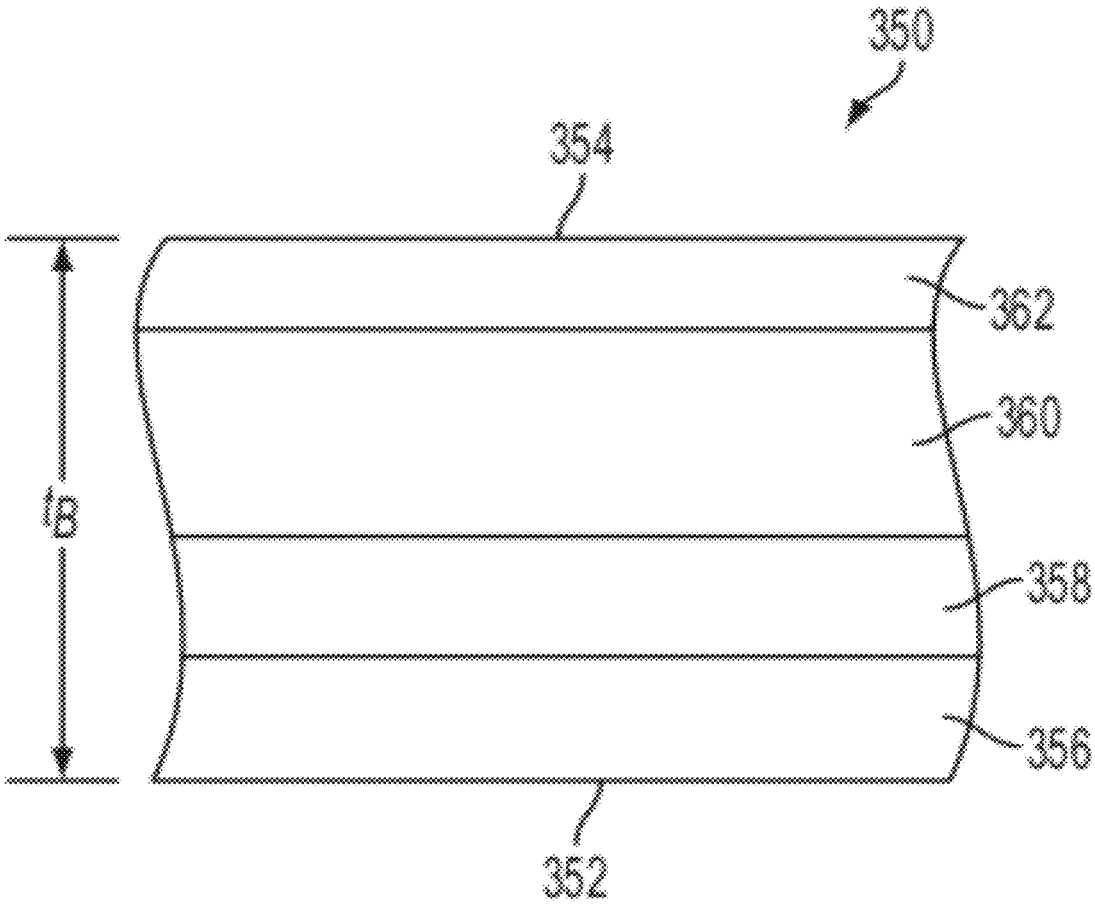
FIG. 4 depicts an exemplary embodiment of the layer structure of a fixing belt of the fixing device shown in FIG. 3.

The fixing belt 350 has a multi-layer construction and includes an inner surface 352 and the outer surface 354. FIG. 4 depicts an exemplary layer structure of the fixing belt 350. As shown, the fixing belt 350 includes a base layer 356 including the inner surface 352, a susceptor layer 358 on the base layer 356, an elastomer layer 360 on the susceptor layer 358 and an outer layer 362 on the elastomer layer 360. The outer layer 362 includes the outer surface 354.

The base layer 356 comprises a polymeric material, such as polyimide, or the like. The base layer 356 can typically have a thickness of about 80 μm to about 120 μm. The susceptor layer 358 can have the same composition and dimensions as embodiments of the susceptor layer 228 of the fixing roll 220 of the fixing device 200, for example. The elastomer layer 360 can comprise silicone rubber, or the like. The elastomer layer 360 can typically have a thickness of about 0.1 mm to about 0.3 mm. The outer layer 362 can comprise any suitable polymeric material having sufficient release properties, such as Viton®, Teflon®, Teflon® PFA, a perfluoroalkoxy copolymer, and the like. The outer layer 362 can typically have a thickness of about 10 μm to about 30 μm.

The fixing belt 350 can typically have a width of about 350 mm to about 450 mm, and a length of about 500 mm to 1000 mm, or even longer.

The magnetic field generator 340 is operable to produce a magnetic field effective to inductively heat the fixing belt 350 to a desired temperature. Eddy currents are generated in the susceptor layer 358 when the magnetic field generator 340 produces the magnetic field. The electrical resistance of the susceptor layer 358 in response to the eddy currents produces heating of the susceptor layer 358. The ferromagnetic layer 324 increases the induced eddy current in the susceptor layer 358. Thermal energy is conducted outward from the susceptor layer 358 to heat the outer surface 354 of the fixing belt 350.

In the fixing belt 350, the ratio of ρ/t of the susceptor layer 358 can be optimized by material selection and processing to maximize eddy current heating of the susceptor layer 358 and, consequently, maximize heating of the fixing belt 350. The optimum range of the ratio of ρ/t of the susceptor layer 358 is dependent on the frequency of the RF power supply 344.

In embodiments, it may be desirable to make the susceptor layer 358 from at least one material having a higher resistivity, e.g., at least about $1\times10^{-5}$ Ω·cm, or at least about of $1\times10^{-4}$ Ω·cm, such as carbon nanotubes, or the like, to allow the susceptor layer 358 to have a greater thickness than a material with a lower resistivity would need to have, in order to provide the same value of the ratio of ρ/t for the susceptor layer 358. By using a material for the susceptor layer 358 that has a high resistivity, processing latitude can be increased for the fixing belt 350.

In embodiments, the thickness of the susceptor layer 358 can typically range from about 10 μm to about 200 μm for different materials. The ratio of ρ/t of the susceptor layer 358 can typically range from about 0.005 Ω·cm/cm to about 0.1 Ω·cm/cm to provide desirable heating of the fixing belt 350 for frequencies ranging from about 10 kHz to about 400 kHz.

EXAMPLES

Figure 5:
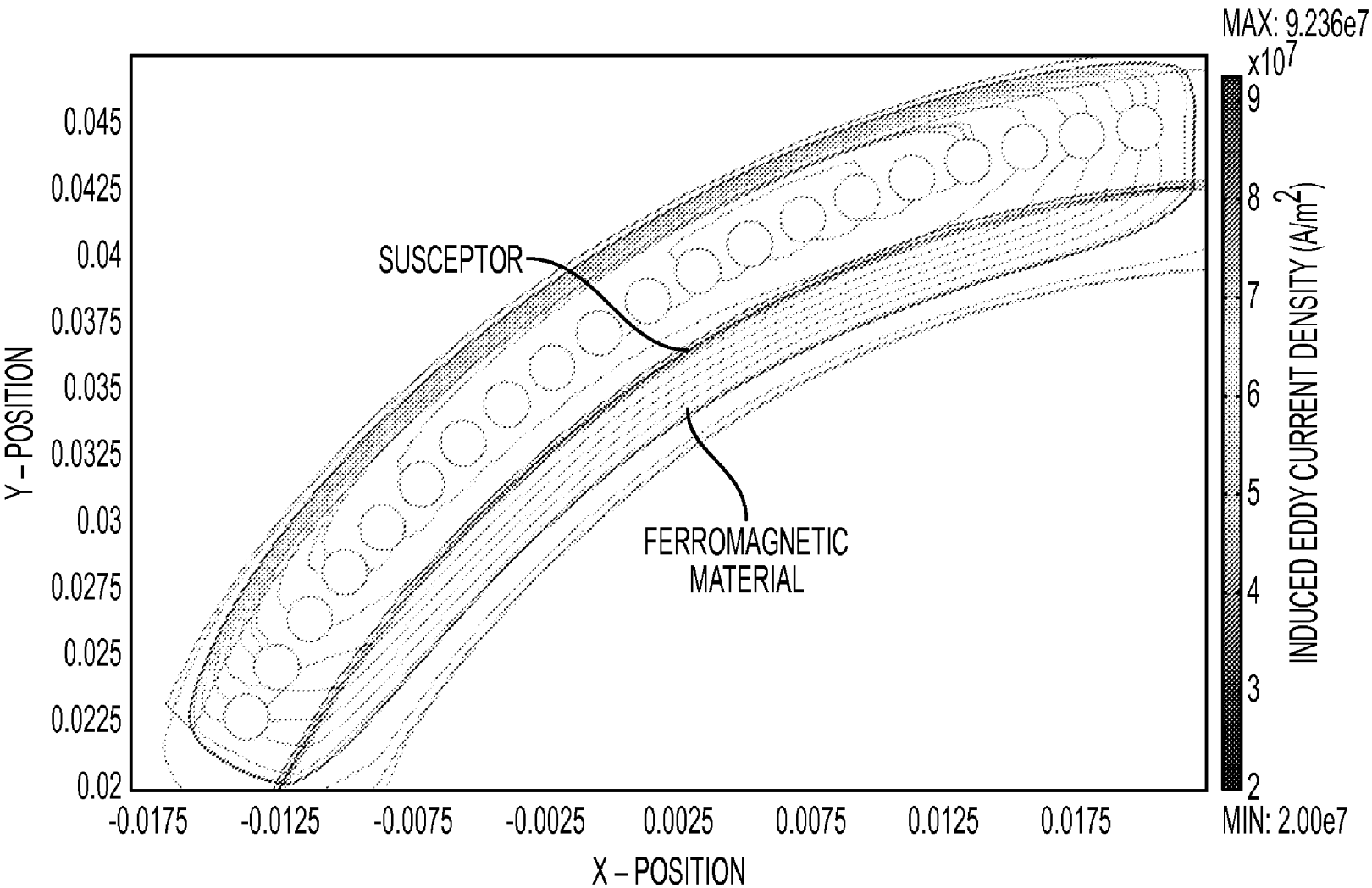
FIG. 5 shows a plot of the eddy current density induced in a susceptor layer overlaid with streamlines of the magnetic flux in a fixing device including a fixing belt having a susceptor layer comprising carbon nanotubes and a backer roll including a layer comprising a ferrite material.

FIG. 5 shows a modeled plot of the induced eddy current density in a backer roll and an overlying fixing belt of a fixing device with overlaid streamlines of the magnetic flux. The backer roll includes a ferromagnetic layer composed of Ferrite N41 (relative magnetic permeability $\mu_R$=3000). The fixing belt includes a base layer composed of polyimide having a thickness of 60 μm, a susceptor layer composed of carbon nanotubes having a thickness of 80 μm overlying the base layer, a silicone rubber layer having a thickness of 200 μm overlying the susceptor layer, and an outer layer composed of Teflon® PFA having a thickness of 30 μm. The magnetic flux penetrates through the ferromagnetic layer, generating a steep magnetic field gradient across the susceptor layer. The induced current density is proportional to the gradient of the magnetic field.

Figure 6:
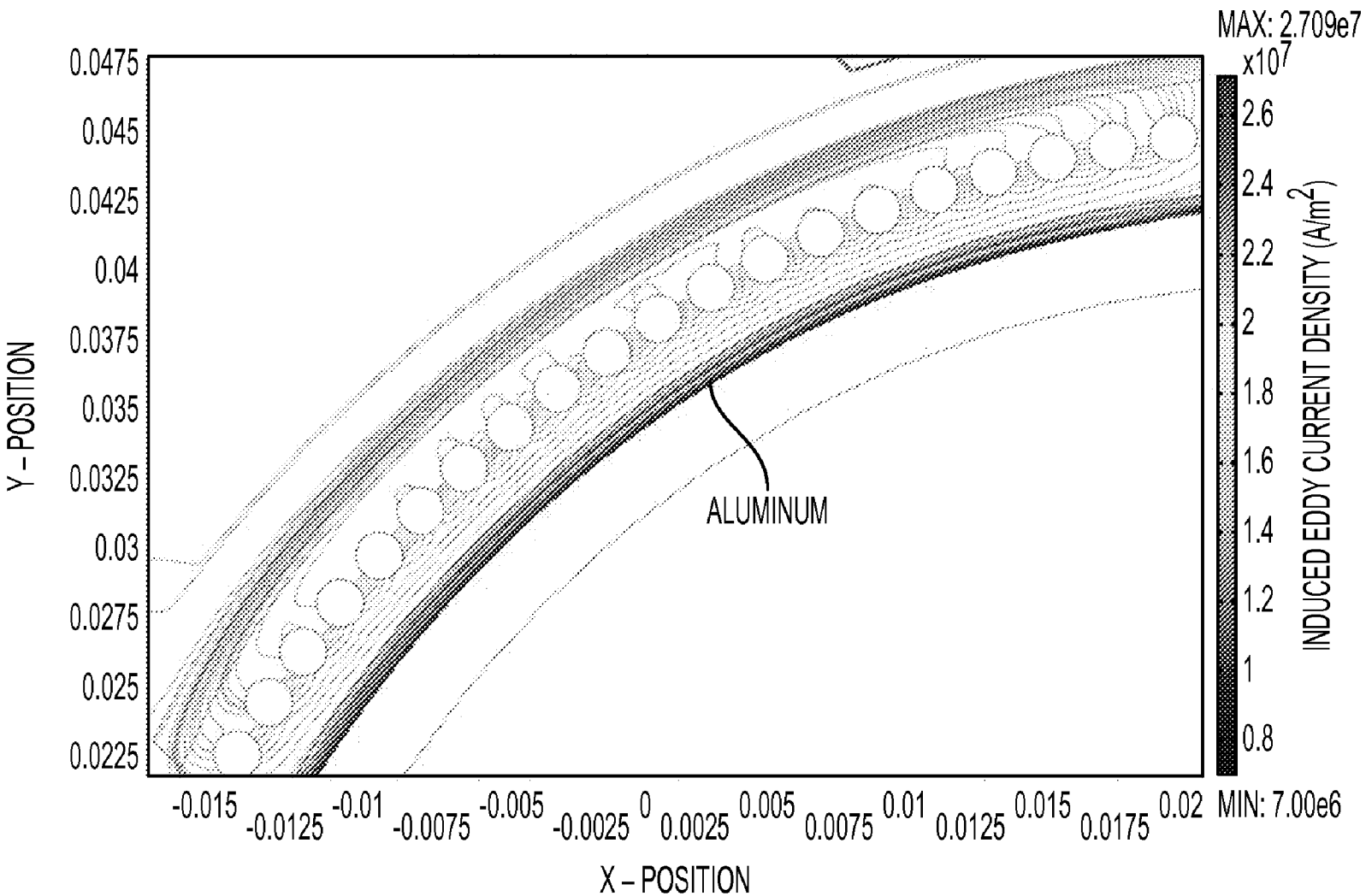
FIG. 6 shows a plot of eddy current density induced in a susceptor layer overlaid with streamlines of the magnetic flux in a fixing device including a fixing belt having a susceptor layer comprising carbon nanotubes and a backer roll including a layer comprising aluminum.

FIG. 6 shows a modeled plot of the induced eddy current density in a backer roll and overlying fixing belt of a fixing device with overlaid streamlines of the magnetic flux. In the backer roll, an aluminum layer (relative magnetic permeability $\mu_R$=1) replaces the Ferrite N41 layer of the backer roll depicted in FIG. 5. The fixing belt has the same construction as that of the fixing belt depicted in FIG. 5. In FIG. 6, the magnetic flux does not go through the aluminum layer of the backer roll and the current is mostly induced in the aluminum layer and not in the susceptor layer composed of carbon nanotubes. The induced current density also is significantly smaller than achieved in the fixing device depicted in FIG. 5.

Figure 7:
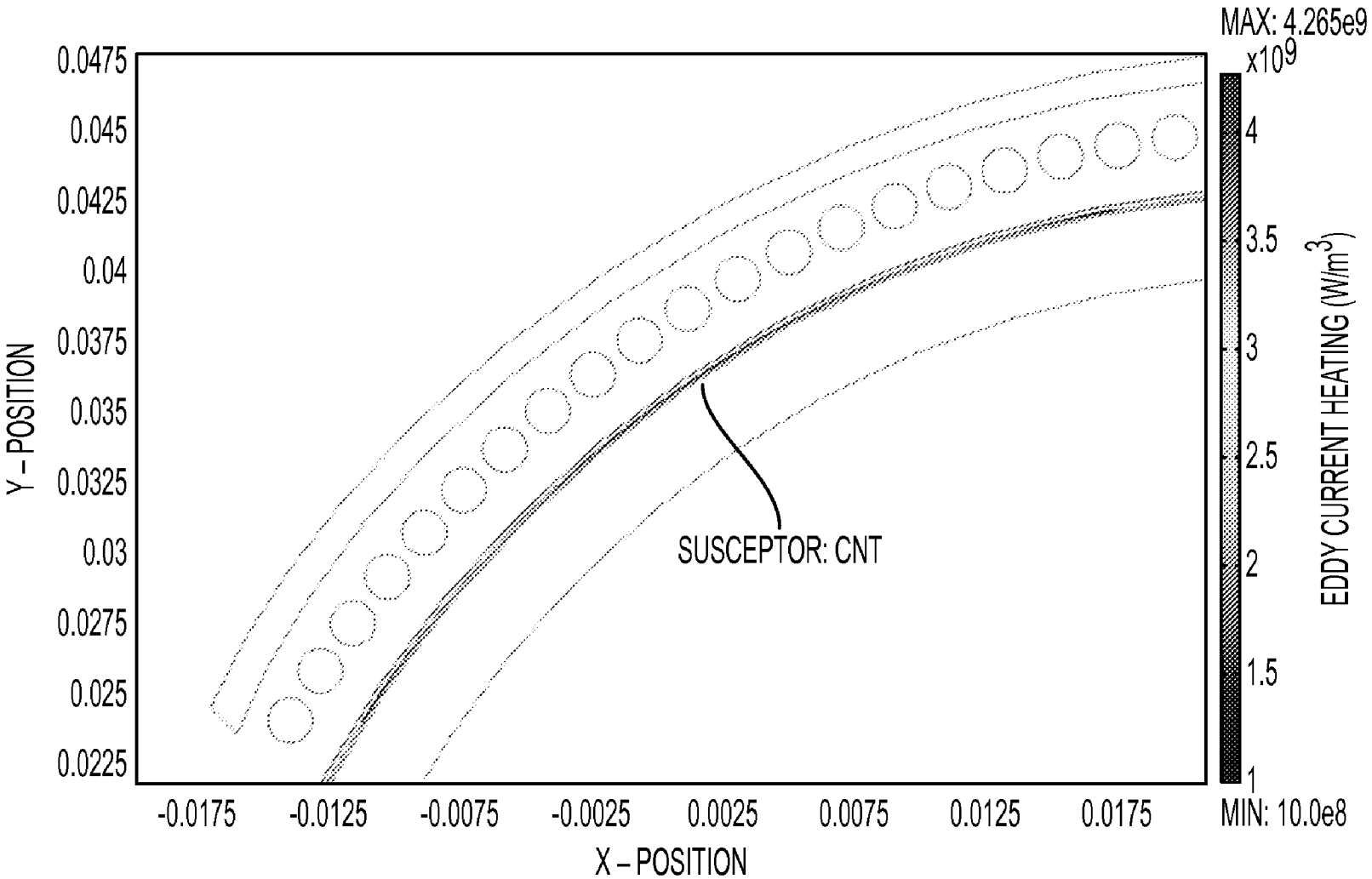
FIG. 7 shows a plot of eddy current heating induced in a fixing device including a fixing belt having a susceptor layer comprising carbon nanotubes and a backer roll including a layer comprising of a ferrite material.

FIG. 7 shows a modeled plot of the eddy current heating per unit volume (W/m$^3$) produced in a fixing device having the same construction as the fixing device depicted in FIG. 5 including a Ferrite N41 layer in the backer roll. As shown in FIG. 7, most of the heating is induced in the susceptor layer composed of carbon nanotubes (resistivity of $1\times10^{-4}$ Ω·cm and thickness of 80 μm) in the fixing belt. An integration of the per unit volume heating provides the eddy current heating per unit length induced in the belt as: 29128 W/m.

Figure 8:
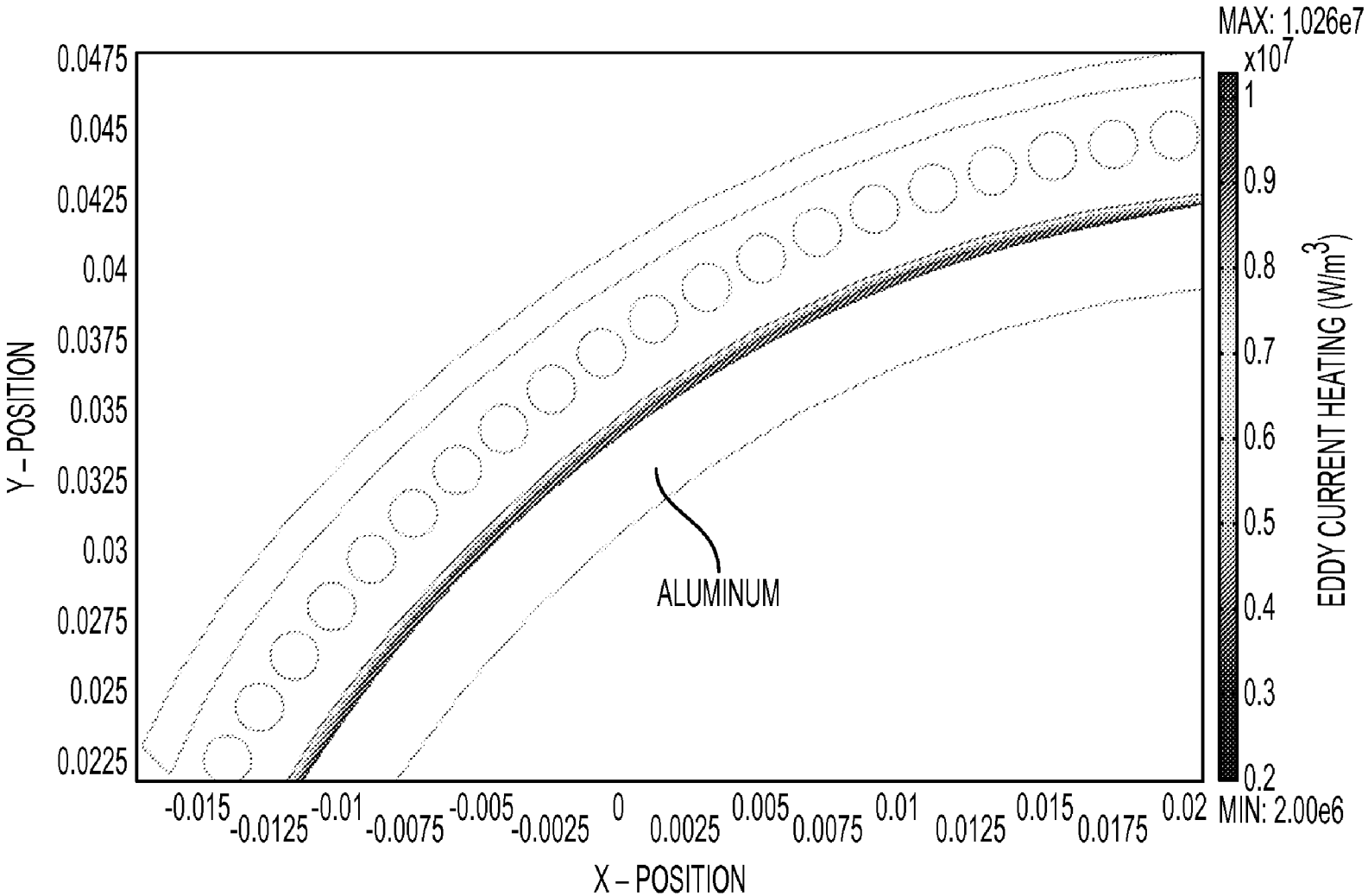
FIG. 8 shows a plot of eddy current heating induced in a fixing device including a fixing belt with a susceptor layer comprising carbon nanotubes and a backer roll including a layer comprising aluminum.

FIG. 8 shows a modeled plot of the eddy current heating per unit volume (W/m$^3$) produced in a fixing device having the same construction as the fixing device depicted in FIG. 6 including an aluminum layer in the backer roll. As shown in FIG. 8, most of the heating is induced in the aluminum layer and the amount of heating is significantly smaller than in the fixing device depicted in FIG. 7. An integration of the per unit volume heating shows that in this case 137 W/m are produced in the backer roll and 1.58 W/m are produced in the fixing belt.

Comparing the heating produced in the fixing device depicted in FIG. 7 to that produced in the fixing device depicted in FIG. 8, the incorporation of the Ferrite N41 layer having a high relative magnetic permeability in the backer roll results in significantly improved heating in the susceptor layer of the fixing belt. As this heating is typically monotonic in current and frequency, these results show that a substantial reduction in Amp-turns and/or frequency in the induction coil of the magnetic field generator is/are achieved with a backer roll including a material having a high relative magnetic permeability (or in a fixing roll including a material having a high relative magnetic permeability).

Figure 9:
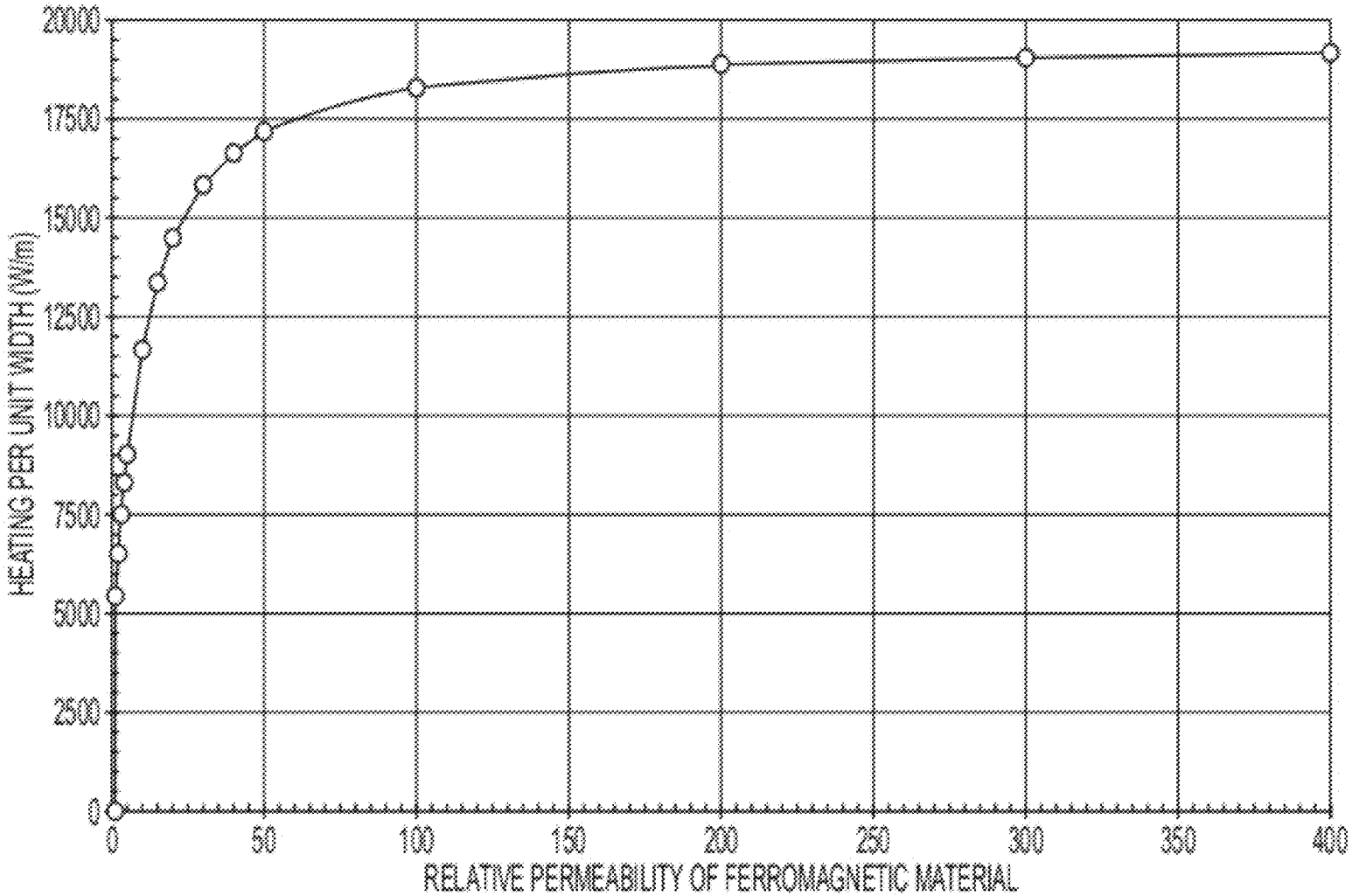
FIG. 9 shows a plot of eddy current heating induced in a susceptor layer of a fixing member as a function of the relative magnetic permeability of another layer underlying the susceptor layer.

FIG. 9 shows a modeled plot demonstrating the effect of the relative magnetic permeability of a ferromagnetic layer of a fixing roll (FIG. 2) or backer roll (FIG. 3) on the eddy current heating induced in the susceptor layer of the fixing roll (FIG. 2) or a fixing belt (FIG. 3). The plot shows a large heating effect even for materials that have a relative permeability slightly higher than 1. FIG. 9 shows a saturation regime for relative magnetic permeability values greater than 100, where heating is only slightly increased by a further increase in the relative magnetic permeability. The relative magnetic permeability at which saturation is achieved depends on the thickness of the ferromagnetic layer.

Figure 10:
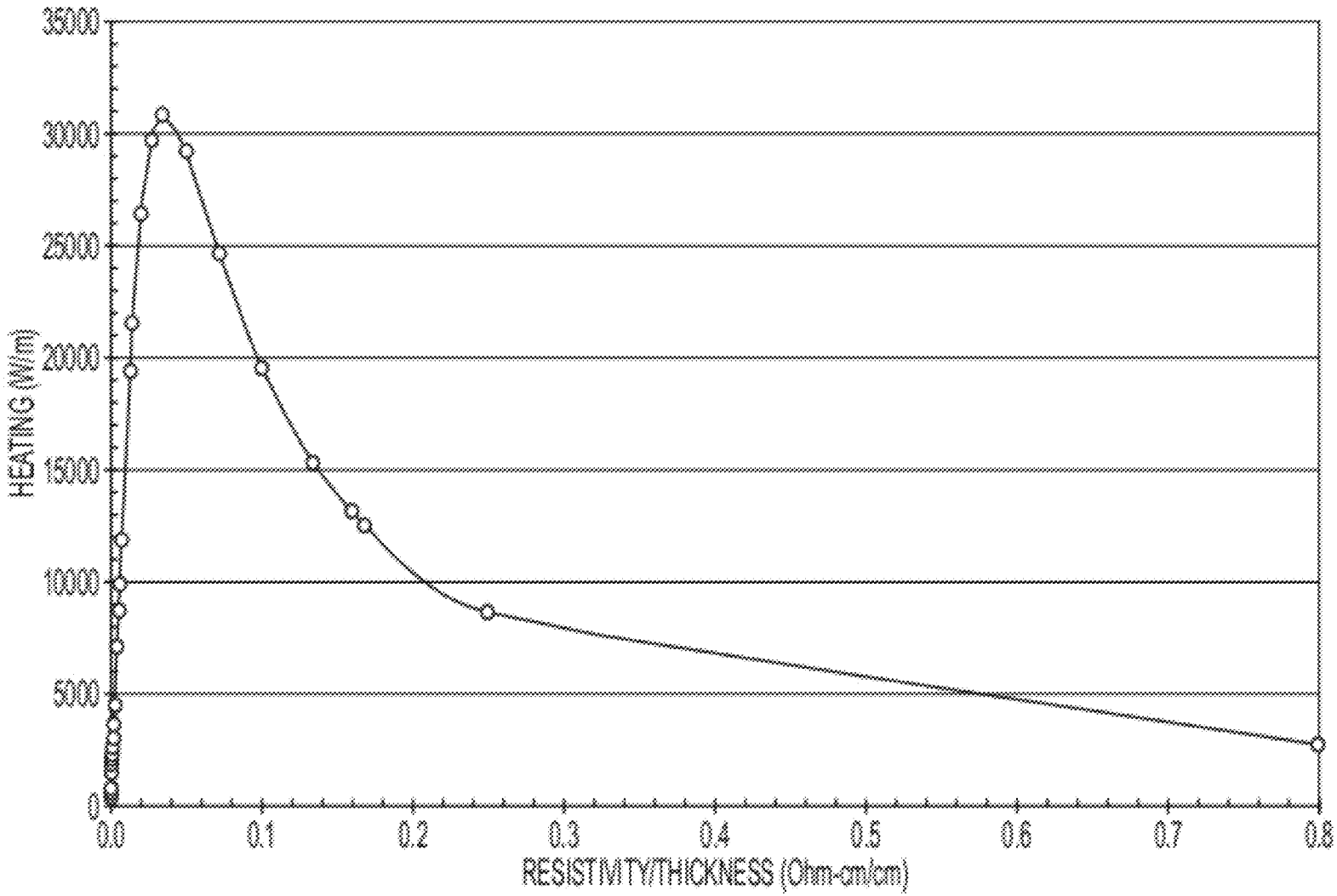
FIG. 10 shows a plot of eddy current heating in a susceptor layer of a fixing member as a function of the ratio of resistivity/thickness of the susceptor layer.

FIG. 10 shows a modeled plot of eddy current heating induced in a susceptor layer of a fixing roll (FIG. 2) or a fixing belt (FIG. 3) as a function of the ratio of resistivity/thickness of a material forming the susceptor layer. The illustrated plot is for a power supply of the magnetic field generator operating at a frequency of 50 kHz. As shown, there is an optimum range of R/t over which the heating is maximized.

For the simulated plots depicted in FIGS. 5 to 8, the susceptor layer composed of carbon nanotubes has a resistivity of $1\times10^{-4}$ Ω·cm and a thickness of 80 μm, giving a ratio ρ/t=0.0125. As shown in FIG. 10, even higher heating is achieved by using a susceptor layer having a ratio of ρ/t of about 0.034 by making the susceptor layer 30 μm thick. For other susceptor materials that have a lower resistivity than carbon nanotubes, such as copper, nickel, silver, and the like, a susceptor layer thickness of only a few microns, or even submicrons, achieves optimal heating.

FIG. 11 shows plots of temperature as a function of time in a fixing device including a backer roll including a layer composed of Ferrite N41 and a fixing belt having a width of 400 mm and including a susceptor layer composed of carbon nanotubes. In this simulation, the induction coil of the magnetic field generator has 300 Amp-turns, the power supply frequency is 50 kHZ, the eddy current heating, based on the results of the induction heating simulation, is: 29128 W/m× 0.4 m=11.5 kW, and the process speed is 350 ppm.

With this amount of heating, a simulation using a three-dimensional heat transfer simulation model was run with the fixing belt operating at a high speed of 350 ppm. FIG. 11 shows the calculated temperature as a function of time at three different locations in the fixing device: (a) at the susceptor layer at the end of the heating zone ($HZ_O$), (b) at the outer surface of the fixing belt proximate to the entrance of the nip formed with the pressure roll, and (c) at the marking material-medium interface. As shown, the fixing device warms-up in about two minutes and the marking material-medium temperature at the nip exit with the fixing belt running at a speed of 350 ppm is 125° C. This temperature is sufficiently-high to satisfactorily fix typical marking materials in the fixing device.

FIG. 12 shows modeled plots of maximum fixing belt outer surface temperature as a function of process speed in contact-type fixing devices including one heated roll, two heated rolls and three heated rolls contacting the fixing belt, and in a fixing device as depicted in FIG. 3 including an inductively-heated fixing belt supported by a backer roll, in order to achieve the same marking material fixing performance. As shown in FIG. 12, at a process speed of 350 ppm, the maximum belt temperature with the inductively-heated fixing belt is 7° C. lower than the maximum belt temperature with three-roll contact heating, and 25° C. lower than with one-roll contact heating.

FIG. 13 shows plots of temperature as a function of time in a fixing device including a backer roll including a layer composed of Ferrite N41 and a fixing belt having a width of 400 mm and including a susceptor layer composed of copper. In this simulation, the induction coil of the magnetic field generator has 1000 Amp-turns, the power supply frequency is 50 kHz, and the eddy current heating is 10.5 kW, and the process speed is 350 ppm.

The plots in FIG. 13 show that to achieve the same high speed fixing performance as depicted in FIG. 11, but using a fixing belt including a susceptor layer composed of copper, or another material having a similar resistivity as copper, the induction coil needs to have more than three times as many Amp-turns (i.e., 1000 vs. 300) as an induction coil in a fixing device including a susceptor layer composed of carbon nanotubes, or of another material having a similar high resistivity, to achieve the same speed of 350 ppm. Accordingly, in embodiments of the fixing devices including a susceptor layer comprising a material having high resistivity, such as nano-sized carbon particles, the total surface area of the induction coils can be reduced, allowing the size of the fixing devices to be reduced.

Embodiments of the fixing devices can also provide higher fixing speeds due to the confined heating achievable in fixing rolls and/or fixing belts of the fixing devices. Embodiments of the fixing devices can also be operated at lower power supply currents to produce sufficient heating of the fixing rolls and/or fixing belts, which allows for incorporation of low-cost power supplies in the apparatuses.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:
- a first member comprising a first surface;
- a second member comprising:
  - at least one ferromagnetic material having a relative magnetic permeability greater than 1;
  - a susceptor over the at least one ferromagnetic material, the susceptor comprising at least one electrically resistive metal; and
  - a second surface over the at least one ferromagnetic material and the susceptor, the second surface forming a nip with the first surface at which media are received; and
- a magnetic field generator for generating a magnetic field to inductively heat the second member.

2. The apparatus useful in printing according to claim 1, wherein the at least one ferromagnetic material comprises at least one ferrite.

3. The apparatus useful in printing according to claim 2, wherein the at least one ferromagnetic material consists essentially of the at least one ferrite.

4. The apparatus useful in printing according to claim 1, wherein the susceptor has an electrical resistivity of at least about $1\times10^{-5}$ Ω·cm.

5. The apparatus useful in printing according to claim 4, wherein the susceptor has an electrical resistivity of at least about $1\times10^{-4}$ Ω·cm.

6. The apparatus useful in printing according to claim 1, wherein the susceptor comprises carbon particles.

7. The apparatus useful in printing according to claim 6, wherein the susceptor consists essentially of carbon nanotubes and has a thickness of about 50 μm to about 200 μm.

8. The apparatus useful in printing according to claim 1, wherein:
- the magnetic field generator comprises at least one induction coil disposed external to the second surface and an RF power supply operable to supply electrical current at a frequency, f, of about 10 kHz to about 400 kHz to the at least one induction coil; and
- the susceptor has a resistivity, ρ, a thickness, t, and a ratio of ρ/t of about 0.005 Ω·cm/cm to about 0.1 Ω·cm/cm.

9. An apparatus useful in printing, comprising:
- a first roll comprising a first surface;
- a second roll comprising:

a ferromagnetic layer comprising at least one ferromagnetic material having a relative magnetic permeability greater than 1;

a susceptor layer over the ferromagnetic layer, the susceptor layer comprising at least one electrically resistive metal; and a second surface over the ferromagnetic layer and the susceptor layer, the second surface forming a nip with the first surface at which media are received; and a magnetic field generator for generating a magnetic field to inductively heat the second roll.

10. The apparatus useful in printing according to claim 9, wherein the ferromagnetic layer consists essentially of at least one ferrite.

11. The apparatus useful in printing according to claim 10, wherein the at least one ferrite is selected from the group consisting of Ferrite U60, Ferrite M33, Ferrite N41 and Ferrite T38.

12. The apparatus useful in printing according to claim 9, wherein the susceptor layer has an electrical resistivity of at least about $1\times10^{-4}$ Ω·cm.

13. The apparatus useful in printing according to claim 9, wherein the susceptor layer consists essentially of carbon nanotubes and has a thickness of about 50 μm to about 200 μm.

14. The apparatus useful in printing according to claim 9, wherein the magnetic field generator comprises at least one induction coil configured to extend circumferentially about the second surface of the second roll over an angle of about 60° to about 180°.

15. The apparatus useful in printing according to claim 9, wherein:

the magnetic field generator comprises at least one induction coil external to the second surface of the second roll and an RF power supply operable to supply electrical current at a frequency, f, of about 10 kHz to about 400 kHz to the at least one induction coil; and the susceptor layer has a resistivity, ρ, a thickness, t, and a ratio of ρ/t of about 0.005 Ω·cm/cm to about 0.1 Ω·cm/cm.

16. An apparatus useful in printing, comprising:

a first roll comprising a first surface;

a second roll comprising a ferromagnetic layer comprising at least one ferromagnetic material having a relative magnetic permeability greater than 1;

a fixing belt provided on the second roll, the fixing belt comprising:

a susceptor layer comprising at least one electrically resistive metal; and a second surface forming a nip with the first surface at which media are received; and a magnetic field generator for generating a magnetic field to inductively heat the fixing belt.

17. The apparatus useful in printing according to claim 16, wherein the ferromagnetic layer consists essentially of at least one ferrite.

18. The apparatus useful in printing according to claim 17, wherein the at least one ferrite is selected from the group consisting of Ferrite U60, Ferrite M33, Ferrite N41 and Ferrite T38.

19. The apparatus useful in printing according to claim 16, wherein the susceptor layer has an electrical resistivity of at least about $1\times10^{-4}$ Ω·cm.

20. The apparatus useful in printing according to claim 16, wherein the susceptor layer consists essentially of carbon nanotubes.

21. The apparatus useful in printing according to claim 16, wherein:

the fixing belt overlies a third roll at the nip; and the magnetic field generator comprises at least one induction coil which extends circumferentially about the second surface of the fixing belt over an angle of about 60° to about 180°.

22. The apparatus useful in printing according to claim 16, wherein:

the magnetic field generator comprises at least one induction coil disposed external to the second surface of the fixing belt and an RF power supply operable to supply electrical current at a frequency, f, of about 10 kHz to about 400 kHz to the at least one induction coil; and the susceptor layer has a resistivity, ρ, a thickness, t, and a ratio of ρ/t of about 0.005 Ω·cm/cm to about 0.1 Ω·cm/cm.

23. A method of fixing marking material onto media in an apparatus useful in printing, the apparatus comprising a first member including a first surface, a second member comprising at least one ferromagnetic material having a relative magnetic permeability greater than 1, a susceptor over the at least one ferromagnetic material, the susceptor comprising at least one electrically resistive metal, and a second surface over the at least one ferromagnetic material and the susceptor, the second surface forming a nip with the first surface, and a magnetic field generator, the method comprising:

generating a magnetic field with the magnetic field generator to inductively heat the second member including heating the second surface; and feeding a medium with a marking material thereon to the nip and contacting the medium with the first surface and the heated second surface to fix the marking material onto the medium.

24. The method of fixing marking material onto media in an apparatus useful in printing according to claim 23, wherein the at least one ferromagnetic material consists essentially of at least one ferrite.

25. The method of fixing marking material onto media in an apparatus useful in printing according to claim 23, wherein the susceptor consists essentially of carbon nanotubes and has a thickness of about 50 μm to about 200 μm.

26. The method of fixing marking material onto media in an apparatus useful in printing according to claim 23, wherein:

the magnetic field generator comprises at least one induction coil external to the second surface and an RF power supply which supplies electrical current at a frequency, f, of about 10 kHz to about 400 kHz to the at least one induction coil; and the susceptor has a resistivity, ρ, a thickness, t, and a ratio of ρ/t of about 0.005 Ω·cm/cm to about 0.1 Ω·cm/cm.

27. The method of fixing marking material onto media in an apparatus useful in printing according to claim 26, wherein the frequency, f, of the electrical current and the ratio of ρ/t of the susceptor have values that produce maximum eddy current heating of the susceptor layer.

* * * * *